United States Patent [19]

Hacker

[11] Patent Number: 4,524,553

[45] Date of Patent: Jun. 25, 1985

[54] THERMAL INSULATED BUILDING SLAB

[76] Inventor: John H. Hacker, 714 Eugene Rd., Palm Springs, Calif. 92264

[21] Appl. No.: 496,197

[22] Filed: May 19, 1983

[51] Int. Cl.[3] ..... E02D 27/00

[52] U.S. Cl. ..... 52/169.11; 52/294; 52/365; 52/405

[58] Field of Search ..... 52/169.11, 365, 294, 52/295, 293, 405, 597, 599, 169.5, 699, 678; 404/51

[56] References Cited

U.S. PATENT DOCUMENTS

| | | | |
|---|---|---|---|
| 2,691,293 | 10/1954 | Patterson | 52/295 |
| 2,978,840 | 4/1961 | Tatsch | 52/169.5 |
| 3,238,856 | 3/1966 | Jahn | 404/51 |
| 3,429,241 | 2/1969 | Burton | 404/51 |
| 4,335,548 | 6/1982 | Rehbein | 52/169.11 |
| 4,404,781 | 9/1983 | Gilb | 52/295 |
| 4,422,279 | 12/1983 | Powell | 52/699 |
| 4,466,222 | 8/1984 | Mitchell | 52/678 |

*Primary Examiner*—Henry E. Raduazo
*Assistant Examiner*—Caroline D. Dennison
*Attorney, Agent, or Firm*—Georges A. Maxwell

[57] ABSTRACT

A thermally insulated building foundation structure comprising a monolithic poured concrete foundation extending about the perimeter of a building site and having a plurality of elongate straight sides with flat, vertical outside surfaces with lower portions below the surface of the ground and upper portions above the surface of the ground and having flat, horizontal top surfaces, a thermal insulating girdle about the perimeter of the upper portion of the foundation comprised of a plurality of elongate straight horizontal channel sections in end to end relationship and having vertical outside walls defining the outside surface of said upper portion of the foundation, horizontal top walls defining the outer portion of said top surface of the foundation, horizontal bottom walls and upper and lower flanges on inner edges of the top and bottom walls and cores of thermal insulating material filling the channel sections; and a plurality of anchor units spaced about the girdle and having inner deadman portions set in the concrete and outer portions in secure engagement with the flanges of the channel sections.

12 Claims, 21 Drawing Figures

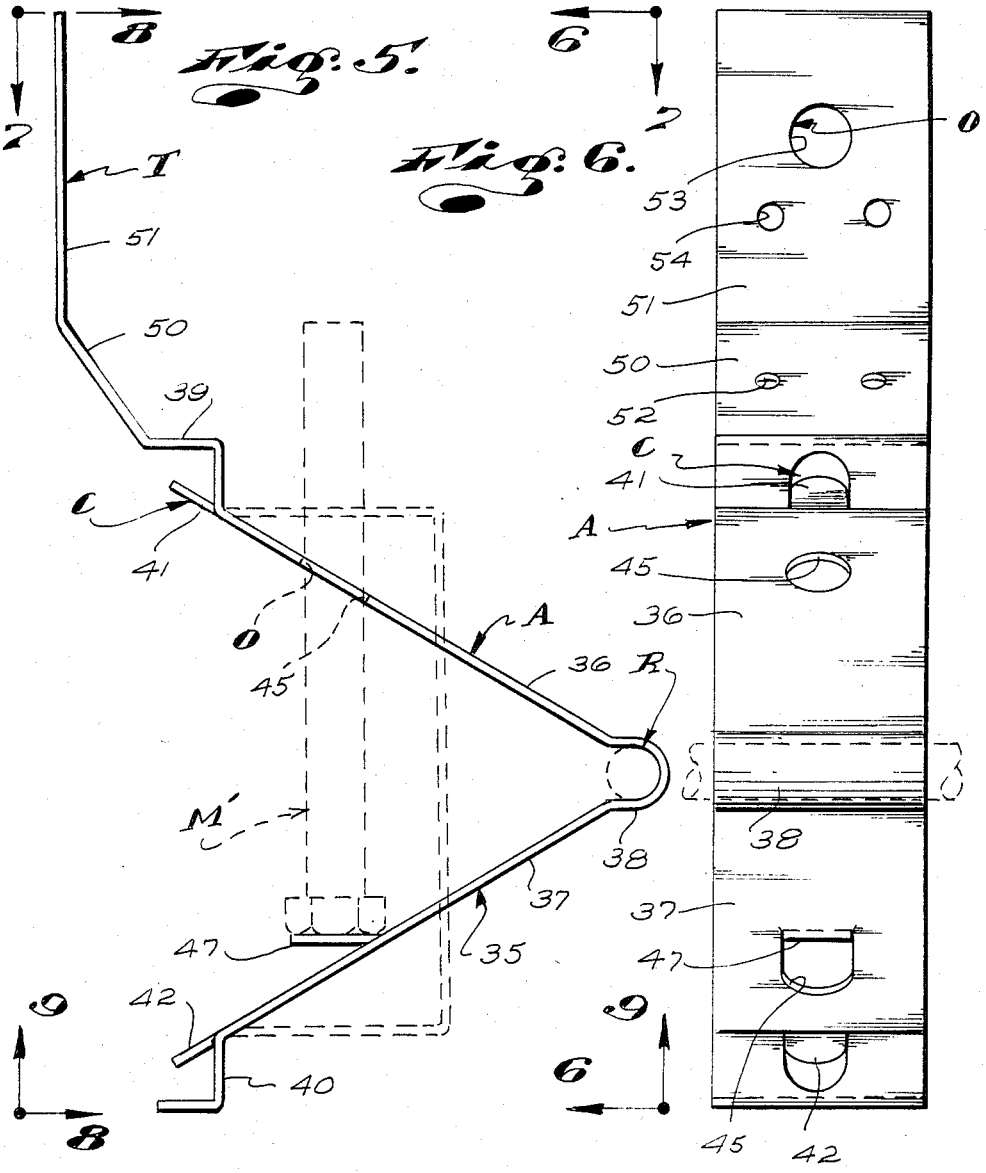
Fig. 5.
Fig. 6.
8
6
7
7
T
51
50
39
C
41
O
45
A
36
R
38
M'
37
35
47
42
40
9
9
8
6
O
53
54
51
50
52
C
41
A
45
36
37
47
45
42
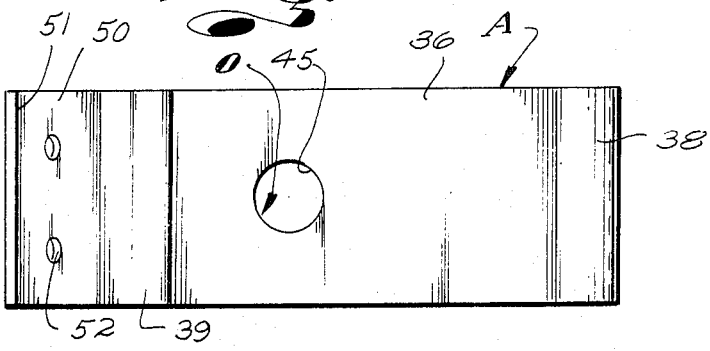
Fig. 7.
51
50
O
45
36
A
38
52
39

THERMAL INSULATED BUILDING SLAB

This invention relates to poured concrete building foundations and is particularly concerned with a novel thermally insulated foundation structure.

BACKGROUND OF THE INVENTION

In the art of constructing a building, it is common practice to first construct a foundation of poured concrete set within and projecting up from ground level at the building site and upon which the remainder of the building is to be constructed. In accordance with old and established practices, such a foundation is characterized by a primary exterior portion which extends about the perimeter of the building site and secondary inside portions which are arranged to occur beneath and afford support for certain of the interior wall structures and the like of the building. Further, in accordance with old and established practices, such foundations are established by first digging upwardly opening trenches in the earth to accommodate the foundations; building upwardly opening box-like wooden forms for the foundations; and then pouring and filling the forms with concrete. After the concrete is set, the wooden forms are stripped or removed and the wood or materials thereof are, most frequently, scrapped. As a general rule, such foundations are rectangular in cross-section; are of predetermined minimal vertical and lateral extent and are established with flat, smooth top surfaces which occur on a set predetermined horizontal plane. It is also common practice when constructing the forms for such foundations to exercise care so as to establish a foundation having a smooth, clean and attractive exterior surface (as by using good quality lumber). Less concern is given to the resulting finish of the inside surfaces of such foundations.

In practice, most foundations of the character referred to are provided with and include a plurality of longitudinally spaced upwardly projecting threaded studs. The studs are provided to effectively secure wood boards or timbers to the tops of the foundations, upon which boards the remainder of the building structures are built. Those boards or timbers are called "mud sills" and are generally established of wood which has been treated to resist rot and are so fastened to their related foundations to establish an effective seal therewith. Such mud sills are often considered integral parts of their related foundations structures.

In some buildings, the foundations support fabricated wood floor structures while in other buildings, the interior space or area defined by the foundations are provided with concrete decks or floors which are poured within the confines of the foundation and finished with a smooth top surface which, for example, is even with the top surfaces of the foundations.

In many areas, building codes require the inclusion of metal reinforcing rods in poured concrete foundations of the character here concerned with.

In most instances, the upper portions of foundations of the character here concerned with project upwardly from the surface of the ground six to eight inches and the exterior surfaces thereof are exposed to all outside elements. That is, they are exposed to freezing temperatures, flood waters, and the like.

In the recent past, those who have studied the construction of buildings to determine the major causes of heat loss with the view that steps might be taken to reduce the cost of heating buildings and conserve fuel have discovered that great quantities of heat is transmitted into and out of buildings through and about their foundations. The heat losses at the foundations of buildings, whether it be from within or outside the buildings, is major. As a result of the foregoing, building codes throughout the country are being modified to require that the exposed exterior surfaces of foundations of the character here concerned with be thermally insulated. To date, to the best of my knowledge and belief, no standard and/or approved thermal insulating means for such foundations has been provided by the prior art. Instead, where codes require that foundations be insulated, those codes have been satisfied by simply cementing or otherwise fixing slabs, batting or sheets of some available thermal insulating material to the exterior surfaces of finished foundations, which foundations are established in accordance with old and established practices. Such insulating means are at best "add-ons" which are seldom attractive or structurally sound.

OBJECTS AND FEATURES OF THE INVENTION

It is an object of my invention to provide novel thermal insulating means for poured concrete building foundations.

It is another object and feature of my invention to provide a novel thermal insulating structure which is incorporated in and forms an integral part of the foundation with which it is related and a structure which includes elements or parts which serve as elements or parts of the forms provided to establish their related foundations with the result that the cost of material and labor to establish such foundations is materially reduced.

Yet another object and feature of my invention is to provide a novel insulating structure of the general character referred to which includes novel means for orienting and securing the mud sills of such foundations in place and which supplements and/or eliminates the need and use of mud sill studs in the foundations.

An object and feature of my invention is to provide a novel thermal insulating structure for concrete foundations which serves an element of the form provided to establish the foundation and which defines a straight and smooth screed supporting surface for easily, conveniently and accurately establishing a straight, smooth top surface on the foundation.

It is another object and feature of my invention to provide a thermal insulating structure of the general character referred to which provides for easy, convenient and accurate placement of mud sill studs and/or reinforcing rods in the foundation, if and when circumstances require such studs and/or rods.

Still another object and feature of my invention is to provide a thermal insulating structure for a poured concrete foundation which includes elongate, laterally inwardly opening U-shaped channel sections of structurally stable material filled with and carrying cores of thermal insulating material, the top and outside surfaces of the channel sections defining the outer and upper exposed portions of the top and outside surfaces of the foundation of which said insulating structure is a part.

Yet another object and feature of my invention is to provide a thermal insulating structure of the character referred to which includes novel anchoring means releasably engageable with the channel sections for selective positioning thereof longitudinally of said sections and which includes portions which extend into and reinforce the foundation and portions which selectively serve to support the channel sections on form supporting stakes and serve to accurately orient and securely anchor mud sills at the tops of the foundations.

It is an object and feature of my invention to provide a thermally effective and structurally stable and durable thermal insulating structure of the general character referred to above which is inexpensive and which greatly simplifies, speeds and reduces the cost of forming a related foundation structure.

The foregoing and other objects and features of my invention will be apparent and fully understood from the following detailed description of typical preferred forms and embodiments of the invention, throughout which description reference is made to the accompanying drawings.

DESCRIPTION OF THE DRAWINGS

FIG. 5 is a view of another part of the invention;

FIG. 6 is a view taken substantially as indicated by line 6—6 in FIG. 5;

FIG. 7 is a view taken substantially as indicated by line 7—7 in FIG. 5;

FIG. 17 is a view taken as indicated by line 17—17 in FIG. 15;

FIG. 19 is a view of the outer side of the part shown in FIG. 18;

DETAILED DESCRIPTION OF THE INVENTION

Figure 1:
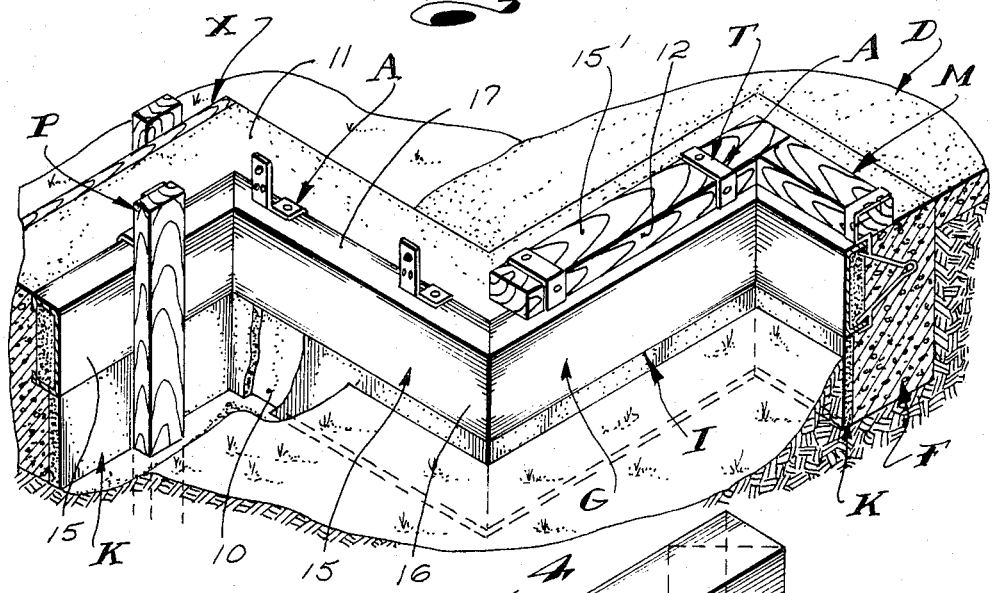
FIG. 1 is an isometric view of foundation embodying my invention.

The thermal insulating structure I that I provide is incorporated in a related poured concrete foundation F and includes a thermal insulating girdle G inserted in the foundation and defining the upper outer exterior corner portion thereof. The foundation structure further includes a mud sill M and a plurality of anchor units A connected with and between the concrete foundation F, girdle G and mud sill M to integrate said elements and parts into a unitary foundation structure.

In addition to the above noted foundation F, girdle G, sill M and units A, the structure I can include a thermal insulating skirt K, about the foundation below the girdle, reinforcing rods R related with and between the foundation F and units A; and mud sill studs M' cooperatively related with and between the units A, foundation F and sill M.

The foundation F is a typical poured concrete building foundation characterized by a primary exterior portion which extends about the perimeter of its related building site and which has a flat, vertical, outwardly disposed exterior or outer surfaces 10 and a flat, horizontal, upwardly disposed top surface 11. The vertical outside surfaces 10 normally occur on vertical planes which are substantially common with the exterior surfaces of the outside walls of a building constructed on the foundation and the top surface 11 occurs on a predetermined set horizontal building plane on and above which the building, carried by the foundation, is to be constructed.

In practice, the foundation structure is characterized by four or more elongate, angularly related straight side portions. It is established by digging an upwardly opening trench in the surface of the earth in which the foundation is to be established, erecting a wooden form for the foundation in the trench, pouring concrete into the form, allowing the concrete to set and thereafter dismantling or stripping the form from the set monolithic concrete structure.

In practice, the concrete portions of such foundations have bottom surfaces which conform to the bottoms of the trenches in which they are formed and have vertical inside surfaces established by the wooden forms. The nature and form of the bottom and inside surfaces of such foundations in no way affects my invention and further consideration thereof will therefore be dispensed with.

Further, in practice, foundations of the general character referred to above are commonly provided with secondary inside portions which are intended to occur below and support interior walls of related buildings. Such secondary portions of such foundations are not affected by and in no way affect my invention and further consideration thereof can and will be dispensed with.

In practice, foundations of the character here concerned with have upper portions which project a limited predetermined distance above the surface of the earth or ground of their related building site and have lower portions which project below the surface of the ground to establish a suitable footing. Most building codes require the upper portions of such foundations to be six inches in vertical extent and require the lower portions to be no less than twelve inches in vertical extent. While some building codes may require the upper portions and/or lower portions of foundations to be more than six inches and twelve inches, respectively, such codes appear to be the exception rather than the rule and can be effectively compensated for in carrying forward my invention.

In practice, the interior floors of many buildings are established of or defined by concrete slabs or decks D formed within the confines of the foundations and finished on a common plane with the top surfaces 11 of the foundations, as shown in FIG. 1 of the drawings.

Further, in practice, ordinary foundations of the character or class here concerned with include wood mud sills M anchored or fixed to the top surfaces 11 of the foundations and which are those parts of the foundation structures to which the buildings, constructed upon the foundations, are fixed. In practice, the mud sill of a building is that element or part which ties or couples the building with its related foundation and can be properly considered or treated as part of the foundation or as a part of the building. Due to special circumstances, I will, for the purpose of this disclosure, consider and treat the mud sill as a part of the foundation structure.

In accordance with common practice, in wood frame buildings, the mud sills M are timbers or boards which are similar in cross-section with the studs or timbers of the frame structure which is applied to or built upon said sills. Further, the mud sills characteristically have flat, vertical outside surfaces 12 which are set inward from the outside surfaces 10 of the foundations a limited predetermined distance which is substantially equal to the thickness of the exterior surface structure of the outer walls of the buildings built on and projecting up from the foundations and so that the exterior surfaces of said outer walls are substantially flush with the exterior surfaces of the foundations. In the majority of instances, the surfaces 12 of the mud sills are set back one inch from the exterior surfaces of the foundations to accommodate a one inch thick lathe and stucco exterior wall surface structure; a one inch thick wood siding exterior wall surface structure or the like.

Some building codes allow the mud sills to be fixed to the top surfaces 11 of the concrete foundations F by means of concrete nails or the like while other building codes require the mud sills to be securely anchored in place, atop the foundations F, by means of threaded studs set in the concrete foundations, projecting through the mud sills and carrying washer and nut assemblies to urge and hold the mud sills tight atop the foundations. Where building codes require the above noted studs to secure mud sills in place, strict adherence to those codes is generally required and cannot be circumvented without the obtaining of special variances.

Figure 2:
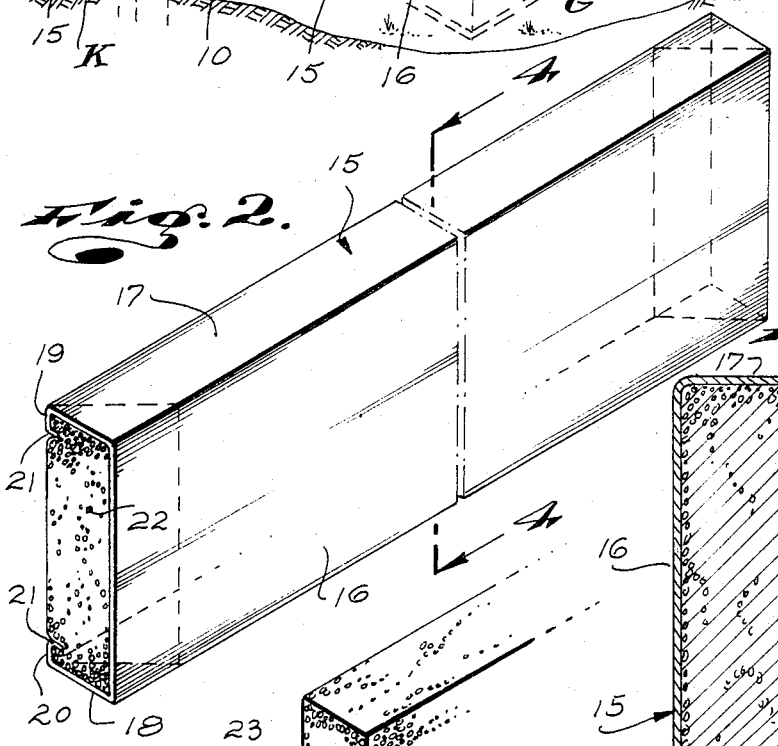
FIG. 2 is an isometric view of a part of the invention.
Figure 4:
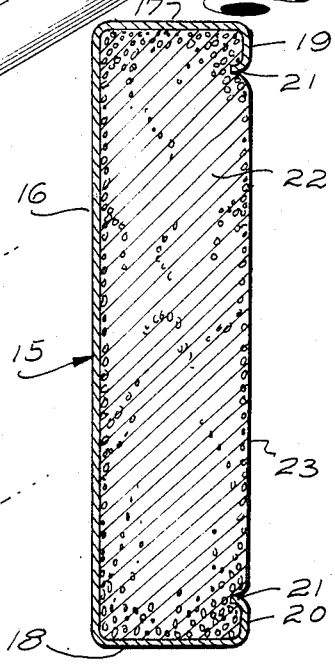
FIG. 4 is an enlarged cross-sectional view taken substantially as indicated by line 4—4 in FIG. 2.
Figure 3:
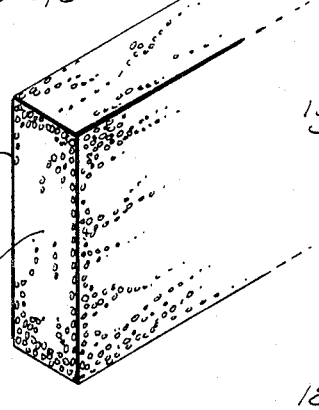
FIG. 3 is an isometric view of a part of the structure shown in FIG. 2.

The girdle G of my new thermal insulating structure I includes a plurality of straight, elongate, horizontal insulator sections arranged in end to end relationship at and along the several sides and about the perimeter of the concrete foundation F. Each insulator section consists of an elongate, horizontal channel section 15 having a flat, vertical outside wall 16, flat, horizontal top and bottom walls 17 and 18 projecting inward from the top and bottom edges of the front wall 16 and vertical, upper and lower rear flanges 19 and 20 depending from the rear edge of the top wall 17 and upwardly from the bottom wall 18, as clearly shown in FIGS. 2 and 3 of the drawings. In practice, the flanges 19 and 20 can be provided with outwardly turned lips 21 along their free edges, as shown. The vertical extent of the section 15 is preferably substantially equal to the required vertical extent of the upper portion of the foundation F, that is, that portion of the foundation which projects above ground level and which is exposed to the ambient atmosphere. Accordingly, the channel sections 15 of the sections S can, as a general rule, be six inches in vertical extent or can be made eight or ten inches in vertical extent, as desired or as circumstances require.

The channel sections 15 can, for example, be one and one-half inches thick and can be provided in standard eight foot lengths.

In practice, the channel sections 15 can be molded or extruded of a suitable durable plastic or can be extruded, break-formed or roll-formed of a suitable metal. In reducing my invention to practice, the channel sections 15 are established of roll-formed, 22 gauge, galvanized sheet iron, in eight foot lengths. (The channels 15 are established of the same standard roll-formed stock employed to establish standard metal wall studs. The advantages of using such standard stock are apparent and need not be recited).

In addition to the channel sections 15, each insulating section includes a core 22 of thermal insulating material, such as semi-rigid polyurethane foam. The core 22 is a cut or extruded length of material which is equal in length and cross-section with the interior of the channel section 15 with which it is related. The core is forcibly and fully inserted into the section 15 from the open rear side thereof so that the flanges 19 and 20 engage over or about the upper and lower rear edge portions of the core and hold it captive within the channel section (as clearly shown in the drawings).

In practice, the inwardly disposed surface of the core 22, at the open rear side of the channel section 15, can be covered with a waterproof or impervious plastic or metal foil skin 23, should the nature of the insulating material of which the core is established require that it be sealed or otherwise protected.

Though many different materials having good thermal insulating characteristics might be advantageously used to establish the cores of the insulator sections, it is preferred that a non-interconnected cellular foam plastic material, which is hydrophobic in nature and which is structurally stable be employed. The plurality of anchoring units A connected with and between the foundation F, girdle G and mud sill M are like units and each is releasably engaged with its related channel section so that the number of units related to each section and the longitudinal spacing or placement of those units can be adjusted and set, as desired or as circumstances require.

Further, in the preferred carrying out of my invention, each anchoring unit A includes orienting means O to orient and support a threaded mud sill bolt or stud M′ and/or retaining means R to retain and support a reinforcing rod in the concrete of the foundation structure.

Still further, in practice, the anchoring unit A that I provide can include an upwardly projecting tie means T to support the structure I when the foundation is being formed and to orient and securely anchor the mud sill M in place when the foundation structure is completed.

In FIGS. 5 through 12 of the drawings and in FIGS. 13 through 21 of the drawings, I have shown two alternative forms of anchoring units A and A′. The anchoring unit A in FIGS. 5 through 12 of the drawings is established of a single length of strap metal stock while the unit A′ shown in FIGS. 13 through 21 of the drawings is established of two strap metal parts.

The anchor unit A is established of a single length of strap metal stock and includes a rear deadman portion 35 comprising inwardly convergent upper and lower legs 36 and 37 joined at their inner ends. In the form of the invention illustrated, the inner ends of the legs are joined by a semi-circular laterally and forwardly opening reinforcing rod receiving seat 38. The outer ends of the upper and lower legs 36 and 37 terminate at forwardly and downwardly and forwardly and upwardly disposed corner seats 39 and 40 to engage about the upper rear and lower rear corner edges of the channel section 15 of their related insulator section. The corner seats 39 and 40 are characterized by flat, vertical inner flanges which engage related rear flanges of the channel section 15 and horizontal flanges which engage related top and bottom walls of the section 15.

The anchor unit A next includes coupling means C to releasably hold the corner seats 39 and 40 in seated engagement with the section 15. The means C includes outwardly projecting tongues 41 and 42 continuing longitudinally outwardly from the outer ends of the legs 36 and 37. The tongues 41 and 42 extend into the interior of the section 15 in holding engagement on or with the edges of the flanges 19 and 20. The tongues 41 and 42 are inclined or angularly related to the flanges 19 and 20 so that they cooperate with the corner seats 39 and 40 to effectively hold their related corner portions of the channel 15 captive.

The anchor unit A is sufficiently resilient so that it can be forcibly biased or sprung into coupled engagement with the channel 15. The coupling means C does not consist of the tongues 41 and 42 alone, but is made up of those tongues in combination with their related corner seats 39 and 40.

Figure 9:
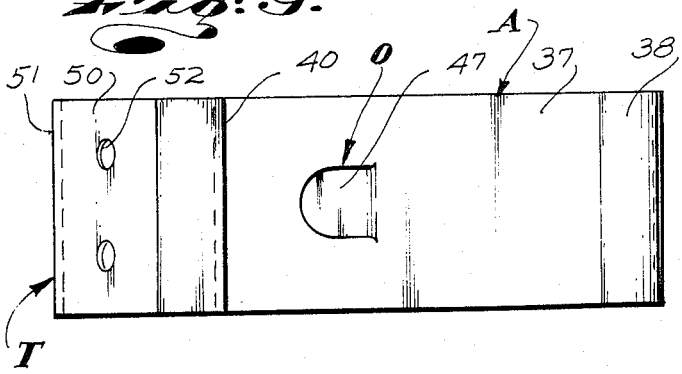
FIG. 9 is a view taken substantially as indicated by line 9—9 in FIG. 5.
Figure 11:
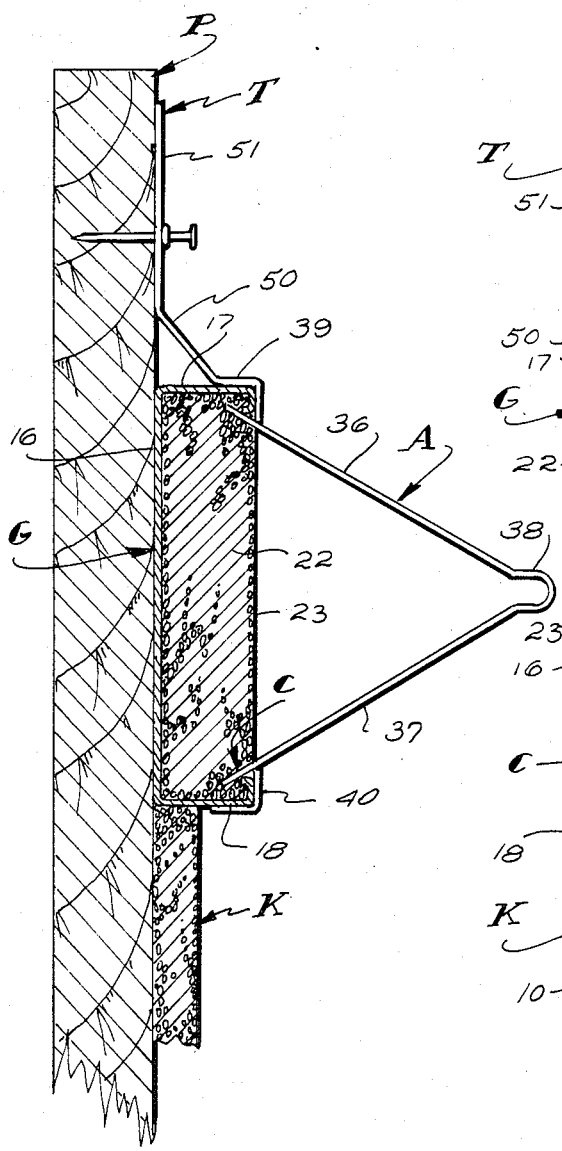
FIG. 11 is a cross-sectional view of my insulating structure related to the form for establishing the foundation.
Figure 12:
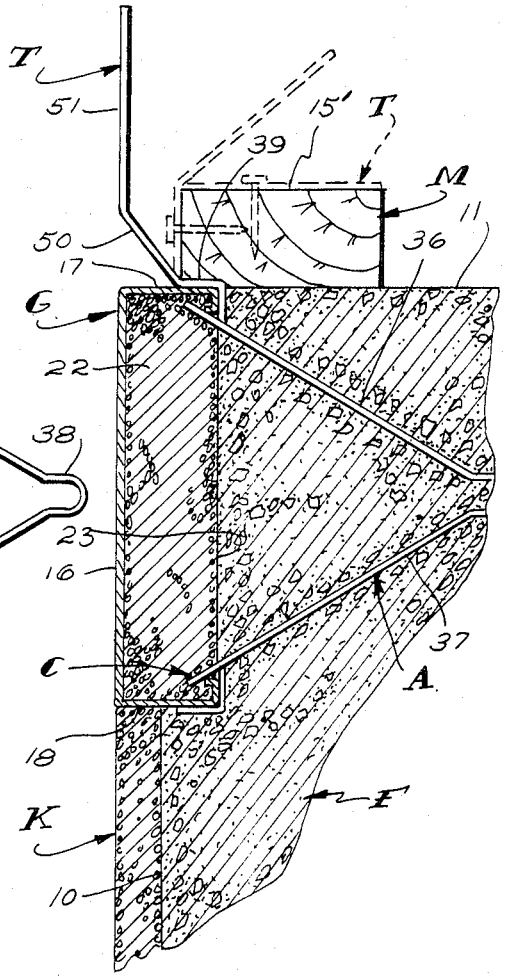
FIG. 12 is a cross-sectional view of the foundation showing my invention related to it.
Figure 13:
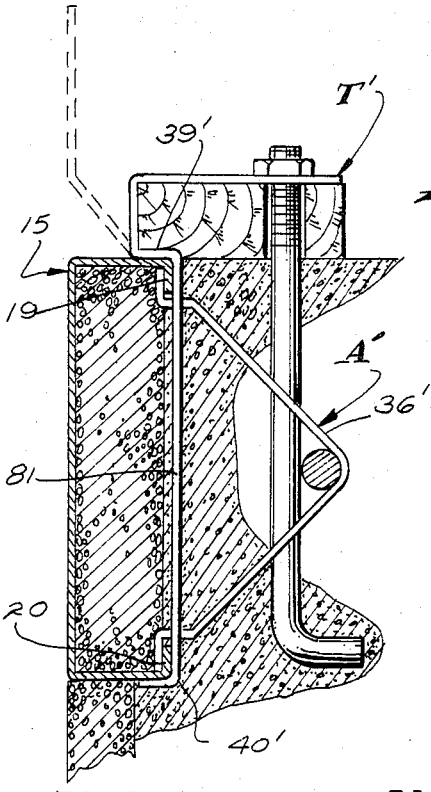
FIG. 13 is a view similar to FIG. 12 showing another embodiment of the invention.
Figure 16:
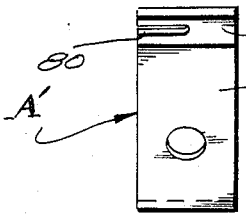
FIG. 16 is a view taken as indicated by line 16—16 in FIG. 15.
Figure 14:
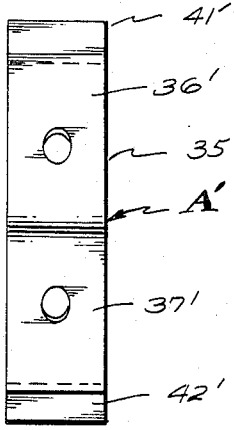
FIG. 14 is a view of the inner side of a part of the structure shown in FIG. 13.
Figure 15:
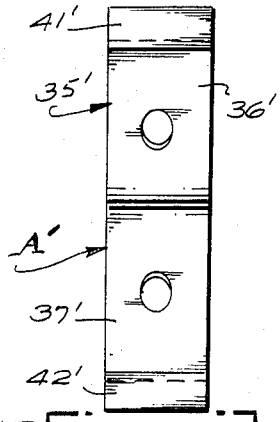
FIG. 15 is a view of the outer side of the part shown in FIG. 14.
Figure 12:
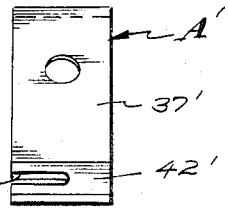
Figure 18:
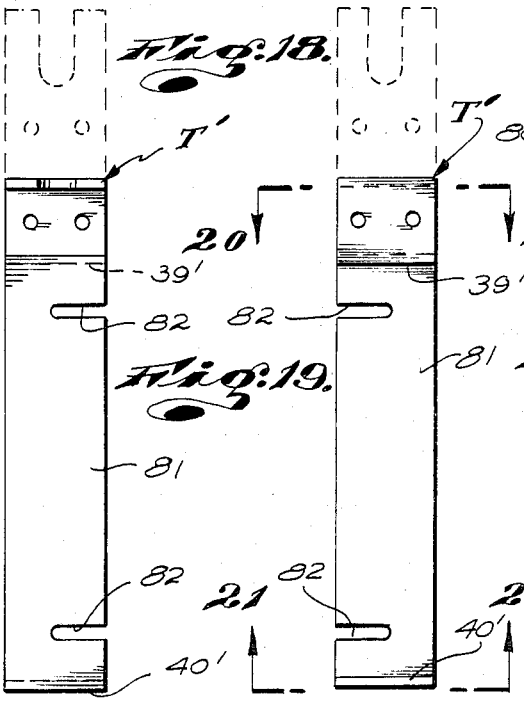
FIG. 18 is a view of the inner side of another part of the structure shown in FIG. 13.
Figure 20:
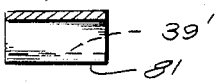
FIG. 20 is a view taken as indicated by line 20—20 in FIG. 19.
Figure 21:
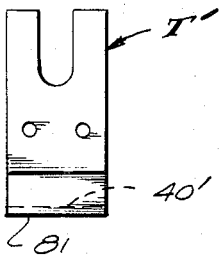
FIG. 21 is a view taken as indicated by line 21—21 in FIG. 19.

In practice, the tongues 41 and 42 are formed of the stock which defines the inner flanges of the corner seats 39 and 40 by suitable piercing and forming of that stock, as clearly shown in FIGS. 5, 6 and 9 of the drawings.

Figure 10:
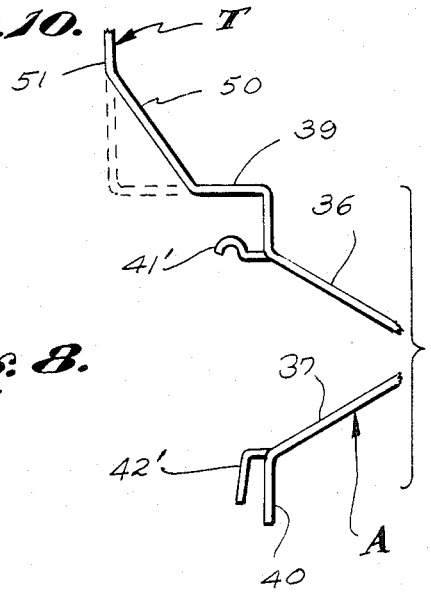
FIG. 10 is a fragmental view of another form of the structure shown in FIG. 6.
Figure 8:
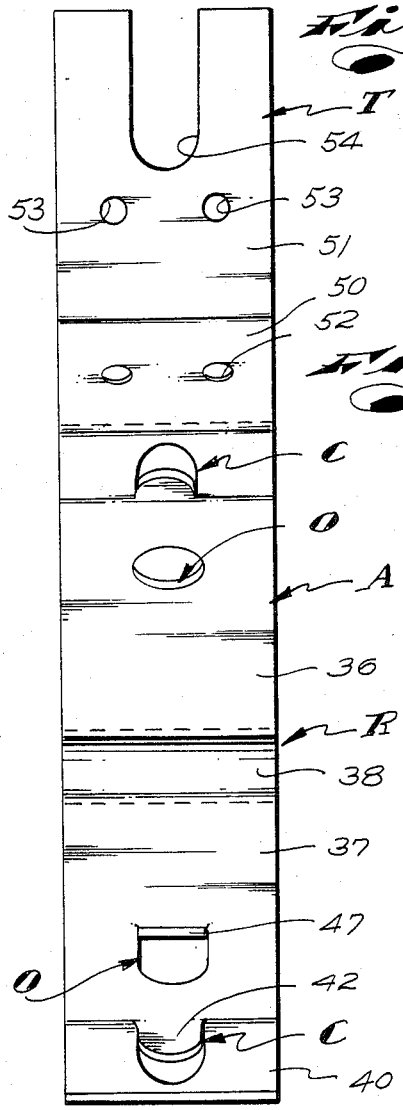
FIG. 8 is a view taken substantially as indicated by line 8—8 in FIG. 5.

In practice and as shown in FIG. 10 of the drawings, the tongue 41' can be formed to establish what is in effect a resilient latch to engage the lower edge portion of the top flange 19 of the section 15 and the tongue 42' can be formed to establish hooked engagement with the lower flange 21 of the section 15. Such modifications of the coupling means is intended to demonstrate the fact that in practice, the form and exact function of the means C is subject to considerable variation, without departing from the broader aspects and spirit of my invention.

While it is preferred that the legs 36 and 37 of deadman portion 35 of the unit A be straight, angularly related converging legs, it will be apparent that they might be otherwise formed without departing from the spirit of my invention. For example, and as shown in dotted lines in FIG. 5 of the drawings, the stock of the unit A can be formed to establish an outwardly opening U-shaped deadman portion.

It is to be noted that while the unit A can be biased and moved relative to its channel section 15, before it is set in the concrete of the foundation F. When it is set in that concrete, it is immovably held and is such that it cannot (under normal circumstances) be worked relative to or released from engagement with the section 15.

It is also to be noted that the deadman portion 35 of the unit A extends well into and is set within the concrete of the foundation F in such a manner that it not only holds the insulator section in fixed relationship in the foundation structure, it also effectively reinforces the concrete in which it is set.

In furtherance of my invention, the unit A is provided with orienting means O to orient and support a threaded mud sill stud M'. The means O includes a pair of vertically aligned openings 45 and 45' in the legs 36 and 37 through which the stud M' can be engaged to project vertically and up from the unit A through the concrete and from the top surface 11 of the foundation F. In practice, if desired, the lower opening 45' can be formed to establish a "knock-out" tab 47 which can serve as a stop or orienting seat for the lower end of the stud M', or which can be "knocked out" or removed to facilitate engaging the stud through the opening 45', as desired or as circumstances require. With such a tab, the effective use of short and inexpensive studs is made possible.

In furtherance of my invention, the anchoring unit A next includes the above referred to tie means T which serves two independent functions. First, the tie means serves as a hangar to support its related insulator section S preparatory to and during forming of the concrete foundation F. Second, it serves to accurately position and anchor or fix the mud sill M of the foundation structure in place atop the foundation F. The tie means T includes a strap metal extension projecting outwardly and upwardly from the top flange of the upper corner seat 39 of the unit. The tie means T is characterized by a straight, normally outwardly and upwardly inclined or lower portion 50 extending outwardly and upwardly from the outer end of the top flange of the corner seat 39 and which is equal in longitudinal extent with the vertical extent of the outside surface 12 of the mud sill M; and a straight, elongate, normally vertical upper portion 51 which extends up from the upper forward end of the lower portion 50 and which is preferably substantially equal in longitudinal extent with the lateral extent of the top surface 15' of the mud sill M. The upper portion 51 normally occurs on a common vertical plane with the outer wall 16 of the channel 15 of its related insulator section and the lower portion 50 is inclined so that its lower inner end terminates at the desired set-in or offset line along the top surface 11 of the foundation F on which the outside surface 12 of the mud sill M is to occur. The lines of joinder between the lower portion 50 of the tie means T and the top flange of the corner seat 39 and between the portions 50 and 51 of the tie means establish break lines along which the stock of the tie means can be conveniently bent.

The lower portion 50 of the tie means T is preferably provided with one or more fastener receiving openings 52 and the upper portion 51 of said tie means is provided with one or more fastener receiving openings 53 and a large opening 54 which is an element or part of the orienting means O and which aligns with the openings 45 and 45' of the means O and to accommodate the upper end portion of a stud M' when the portion 51 is bent and formed to engage the top surface 12' of the mud sill M.

In use and operation, when the foundation F is being established, a suitable form is constructed. The form includes vertical wood posts P driven into the earth at or adjacent the outside vertical plane for the foundation which is to be established. The posts P project up from the proposed top plane for the foundation. The anchoring units A are engaged or assembled with their related sections S of the girdle G, as shown. The upper portions 51 of the tie means T of the units A are temporarily nailed or otherwise fastened to the posts P with the outside walls 16 of the sections 15 in flat supported engagement with the posts and with the top walls 17 of the sections 15 on the plane for top surface 11 of the foundation. Form lumber or permanent sheets of thermal insulating material 60 to define a thermal insulating skirt about the foundation, below the girdle G, are related to and supported by the posts P below the sections S, as shown and as circumstances require.

In addition to the foregoing and in accordance with common practice, the form for the foundation F includes fabricated or assembled form parts to define and/or establish the inside portion of the foundation, such as is shown at X in FIG. 1 of the drawings.

The number and placement of anchoring units A is dictated by code and/or architectural and engineering design.

With the foundation form thus established, reinforcing rods can be suitably engaged with the anchoring units A to extend therethrough and about the interior of the form structure. Also, if desired or required, mud sill studs M′ can be engaged in and with the orienting means O of all or selected anchoring units A, as required.

With the form for the foundation F thus established, concrete is poured into the form structure and is suitably finished even with the top walls of the channel section 15 to establish the top surface 11 of the foundation F. When the concrete is set, the inside parts of the form structure are stripped and the posts P are removed.

Following the above, the timbers or boards provided to establish the mud sill M are sent atop the foundation F with the lower outer corner edges of the boards engaged in the corners established by the upper corner seats 39 and the lower portions 50 of the means T. The portions 50 of the means T are then bent inwardly and upwardly into flat supporting engagement with the outer surfaces 12 of the mud sill boards and can be fastened thereto as by nails engaged through the openings 52 and into said boards. Next, the upper portions 51 of the means T are bent inwardly and downwardly into flat engagement with the top surfaces 12′ of the boards of the mud sill and are fastened thereby as by nails engaged through the openings 53 and into said boards. In those instances where mud sill studs M′ are provided and project up through and from the mud sill, the sill is provided with drill openings to accommodate those studs and the openings 53 in the portions 51 of the means T feely accommodate the upper terminal end portions of the studs.

Finally, and following the above procedure, nuts and washers are engaged on the studs and with the mud sill M to secure the sill in place.

It is to be noted that the foundation structure constructed and finished in the manner set forth above includes the thermal insulating girdle G made up of the insulator sections as an integral part of the foundation F and that the mud sill M of the foundation is accurately positioned and securely integrated in the completed and finished foundation structure by the anchoring units A.

Engineering calculations clearly establish that the anchoring means A here provided anchor and secure the mud sill M in place more securely and accurately than conventional mud sill studs. Accordingly, in practice, it is anticipated that the use of mud sill studs will not be required in those foundation structures embodying my invention.

It is important to note that the removal and stripping of the complete form structure is not required. It is also important to note that the cost of the insulator sections of the girdle G is from five to ten cents a lineal foot less than the cost of standard form lumber and is not destroyed or wasted as is conventional or standard form lumber. It is also important to note that the anchoring units allow for accurate and stable placement of mud sill studs and reinforcing rods in the form structure for the foundation structure in materially less time and with the exercise of notably less skill than is required to accurately and stably place such studs and rods within form structures in accordance with old and conventional practices.

The other form of anchoring unit A′ that I provide and which is shown in FIGS. 13 through 21 of the drawings is, respects, the same or the equivalent of the unit A. The unit A′ distinguishes from the unit A in that the deadman portion 35′ and the corner seat portions with their related tie means T′ are established by two separate pieces of strap metal. The deadman portion 35′ comprises a part with upper and lower outwardly divergent legs 36′ and 37′ with vertical L-shaped tongues 41′ and 42′ at their outer free ends to engage the flanges 19 and 20 of a channel section 15, as shown. The base portions of the tongues 41′ and 42′ are formed with elongate, vertically opening notches 80 which enter one side edge of the unit A′. The unit A′ next includes a second strap metal part with a central vertical portion 81 with upper and lower corner seats 39′ and 40′ formed at the upper and lower ends thereof. The portion 81 occurs adjacent and extends between the upper and lower flanges 19 and 20 of the section 15 and has elongate horizontally opening notches 82 at its upper and lower end portions which notches open at the other side of the unit A′. The notches 80 receive those portions of the noted portion 81 which occur adjacent the notches 82 and the notches 82 receive the portions of the legs 36′ and 37′ which occur adjacent the notches 82 whereby the portion 81 and the legs 36′ and 37′ are securely locked together when the noted parts of the unit A′ are assembled.

The unit A′ is or can be substantially identical with the unit A in all other major aspects.

The difference between the anchoring means A and A′ impart each form of anchor unit with certain apparent advantages and disadvantages but each is effective and practical in use. It has been found that certain tradesmen prefer one form of anchoring unit over the other and it has been determined that in commercial exploitation of my invention, it is desirable to offer more than one embodiment of the invention. Accordingly, the two forms of anchor units described above are intended as alternative structures.

Having described only typical preferred forms and applications of my invention, I do not wish to be limited to the specific details herein set forth but wish to reserve to myself any modifications and/or variations that might appear to those skilled in the art and which fall within the scope of the following claims:

Having described my invention, I claim:

1. A thermally insulated foundation structure comprising a monolithic concrete foundation with a lower portion set in the ground, an upper portion projecting up from the surface of the ground and having a multiplicity of straight sides about its perimeter with horizontal top and vertical outside surfaces; a thermal insulating girdle comprising a plurality of elongate horizontal, U-shaped channel sections in end to end relationship about the perimeter of the upper portion of the foundation at the outside surfaces thereof, said channel sections have vertical, outside walls, vertically spaced horizontal top and bottom walls projecting inward from the outside walls and vertically spaced upper and lower flanges projecting up and projecting down from rear edges of the top and bottom walls; and cores of thermal insulating material within and carried by the channel sections; and a plurality of anchoring units in spaced relationship about the foundation securing the channel sections to the foundation, said anchor units include deadman portions set in the foundation inward of the channel sections and including elongate upper and lower legs extending inward from the channel sections and having formed outside ends engaged with related upper and lower flanges of said channel sections, an elongate wood mud sill on and projecting up from the top surfaces of the foundation adjacent the sides thereof, said mud sill has vertical outside surfaces and horizontal top surfaces, said anchoring units include tie means to orient and secure the mud sill on and to the foundation, said tie means includes elongate extensions on the outer ends of the upper legs, said extensions have vertical lower portions engaging the outside surfaces of the mud sill and horizontal upper portions engaging and fastened to the top surfaces of said mud sill.

2. The thermally insulated foundation structure set forth in claim 1 wherein said upper and lower legs, said upper portion of the tie means and said mud sill have aligned vertical openings and said foundation structure further includes elongate studs with lower portions engaged in the openings in the legs and set in the foundation and upper threaded portions engaged through the openings in the mud sill and upper portion of the tie means and nuts engaged on the studs above and engaging said upper portion of the tie means.

3. The thermally insulated foundation structure set forth in claim 1 wherein portions of the tie means have fastener receiving openings through which fasteners engaged in said mud sill are engaged.

4. The thermally insulated foundation structure set forth in claim 1 wherein said upper and lower legs, said upper portion of the tie means and said mud sill have aligned vertical openings and said foundation structure further includes elongate studs with lower portions engaged in the openings in the legs and set in the foundation and upper threaded portions engaged through the openings in the mud sill and upper portion of the tie means and nuts engaged on the studs above and engaging said upper portion of tie means, portions of the tie means have fastener receiving openings through which fasteners engaged in said mud sill are engaged.

5. The thermally insulated foundation structure set forth in claim 1 wherein the legs of said deadman portion of the anchoring units are formed and define reinforcing rod seats spaced inward from the channel sections, said seats supports adjacent portions of elongate horizontal reinforcing rods extending through the foundation.

6. The thermally insulated foundation structure set forth in claim 1 wherein said upper and lower legs, said upper portion of the tie means and said mud sill have aligned vertical openings and said foundation structure further includes elongate studs with lower portions engaged in the openings in the legs and set in the foundation and upper threaded portions engaged through the openings in the mud sill and upper portion of the tie means and nuts engaged on the studs above and engaging said upper portion of the tie means, said deadman portion of the anchoring units are formed with rod seats spaced inward from the channel sections and supporting adjacent portions of elongate horizontal reinforcing rods extending through the foundation and between the anchoring units.

7. The thermally insulated foundation structure set forth in claim 1 wherein portions of the tie means have fastener openings through which fasteners engaged in the mud sill are engaged, said deadman portion of the anchoring units are formed with rod seats spaced inward from the channel sections said seats support adjacent portions of elongate horizontal reinforcing rods extending through the foundation and between the anchoring units.

8. The thermally insulated foundation structure set forth in claim 1 wherein each anchoring unit is established of a length of strap metal and the outside ends of its legs are formed to establish corner seats with vertical portions engaging the inner sides of related upper and lower flanges and horizontal top portions above and below and engaging the top and bottom walls of a related channel section and elongate tongues at the front ends of the legs projecting into the channel section and engaging said flanges.

9. The thermally insulated foundation structure set forth in claim 1 wherein said upper and lower legs, said upper portion of the tie means and said mud sill have aligned vertical openings and said foundation structure further includes elongate studs with lower portions engaged in the openings in the legs and set in the foundation and upper threaded portions engaged through the openings in the mud sill and upper portion of the tie means and nuts engaged on the studs above and engaging said upper portion of the tie means, the anchoring units are established of a length of strap metal and wherein the outside ends of the legs are formed to establish corner seats with vertical portions engaging the inner sides of related upper and lower flanges of related channel sections and horizontal top portions above and below and engaging the top and bottom walls of said channel sections and establishing elongate tongues at the front ends of the legs projecting into the channel sections in engagement with the flanges thereof.

10. The thermally insulated foundation structure set forth in claim 1 wherein the anchoring units are established of first and second parts, each made of a length of strap metal, said first parts have straight, vertical central portions extending between the upper and lower flanges of related channel sections, vertically and forwardly extending corner seats at the ends of the central portion engaged about the upper and lower rear corner edges of said channel sections, and elongate horizontal slots opening outwardly and inwardly and entering said first parts at one side of the units, said second parts define said elongate, upper and lower legs, the outer end portions of the legs extend through the slots in the first parts and have elongate, horizontal slots opening vertically and entering the legs at the other sides of the units and through which the slotted portions of the first parts extend, the outer ends of the legs have vertical tongues outwardly disposed surfaces of said flanges.

11. The thermally insulated foundation structure set forth in claim 1 wherein said upper and lower legs, said upper portion of the tie means and said mud sill have aligned vertical openings and said foundation structure further includes elongate studs with lower portions engaged in the openings in the legs and set in the foundation and upper threaded portions engaged through the openings in the mud sill and upper portion of the tie means and nuts engaged on the studs above and engaging said upper portion of the tie means, the anchoring units are established of first and second parts, each made of a length of strap metal, said first parts have straight, vertical central portions extending between the upper and lower flanges of related channel sections, vertically and forwardly extending corner seats at the ends of the central portion engaged about the upper and lower rear corner edges of said channel sections, and elongate horizontal slots opening outwardly and inwardly and entering said first parts at one side of the units, said second parts define said elongate, upper and lower legs, the outer end portions of the legs extend through the slots in the first parts and have elongate, horizontal slots opening vertically and entering the legs at the other sides of the units and through which the slotted portions of the first parts extend, the outer ends of the legs have vertical tongues engaging outwardly disposed surfaces of said flanges.

12. The thermally insulated foundation structure set forth in claim 1 wherein the legs of said deadman portion of the anchoring units are formed and define reinforcing rod seats spaced inward from the channel sections, said seats support adjacent portions of elongate horizontal reinforcing rods extending through the foundation, the anchoring units are established of first and second parts, each made of a length of strap metal, said first parts have straight, vertical central portions extending between the upper and lower flanges of related channel sections, vertically and forwardly extending corner seats at the ends of the central portion engaged about the upper and lower rear corner edges of said channel sections, and elongate horizontal slots opening outwardly and inwardly and entering said first parts at one side of the units, said second parts define said elongate, upper and lower legs, the outer end portions of the legs extend through the slots in the first parts and have elongate, horizontal slots opening vertically and entering the legs of the other sides of the units and through which the slotted portions of the first parts extend, the outer ends of the legs have vertical tongues engaging outwardly disposed surfaces of said flanges.

* * * * *